US010753633B2

(12) United States Patent
Henderson et al.

(10) Patent No.: US 10,753,633 B2
(45) Date of Patent: Aug. 25, 2020

(54) DIAGNOSTIC DISPLAY METHOD FOR AN AIR CONDITIONER UNIT

(71) Applicant: Haier US Appliance Solutions, Inc., Wilmington, DE (US)

(72) Inventors: Richard Dustin Henderson, LaGrange, KY (US); Robert Jules LaFleur, Louisville, KY (US); Paul Goodjohn, Crestwood, KY (US)

(73) Assignee: Haier US Appliance Solutions, Inc., Wilmington ( * ) Notice: Subject to any disclaimer, the term of this patent is extended or adjusted under 35 U.S.C. 154(b) by 78 days.

(21) Appl. No.: 15/920,787

(22) Filed: Mar. 14, 2018

(65) Prior Publication Data

US 2019/0285301 A1 Sep. 19, 2019

(51) Int. Cl.

| | |
|---|---|
| ***F24F 11/00*** | (2018.01) |
| ***F24F 11/49*** | (2018.01) |
| ***F24F 11/56*** | (2018.01) |
| ***F24F 11/52*** | (2018.01) |

(52) U.S. Cl.

CPC ..... *F24F 11/49* (2018.01); *F24F 11/52* (2018.01); *F24F 11/56* (2018.01); *F24F 2221/32* (2013.01)

(58) Field of Classification Search

CPC .. F24F 11/32; F24F 11/38; F24F 11/49; F24F 11/52; F24F 2221/32

See application file for complete search history.

(56) References Cited

U.S. PATENT DOCUMENTS

| | | | | |
|---|---|---|---|---|
| 7,188,002 | B2 | 3/2007 | Chapman et al. | |
| 7,434,742 | B2 | 10/2008 | Mueller et al. | |
| 9,535,408 | B2 | 1/2017 | Lingrey et al. | |
| 9,575,496 | B2 * | 2/2017 | Fadell | F24F 11/30 |
| 2001/0000664 | A1 * | 5/2001 | Armstrong | G04G 21/00 345/173 |
| 2014/0102664 | A1 * | 4/2014 | Kim | F24F 1/005 165/11.1 |
| 2017/0059198 | A1 * | 3/2017 | Roth | F24F 11/30 |
| 2017/0241659 | A1 * | 8/2017 | Choi | G05D 23/1917 |
| 2017/0314799 | A1 * | 11/2017 | LeRoy | F24F 11/85 |
| 2018/0031266 | A1 * | 2/2018 | Atchison | F24F 11/30 |

* cited by examiner

*Primary Examiner* — Jonathan Bradford

(74) *Attorney, Agent, or Firm* — Dority & Manning, P.A.

(57) ABSTRACT

A method for operating an air conditioner includes transmitting a plurality of signals between a remote user interface and the air conditioner through a plurality of wires that extend between the remote user interface and the air conditioner when the air conditioner is in a diagnostic mode. Each signal of the plurality of signals corresponds to a respective one of the plurality of wires. The method also include sequentially presenting a respective one or more characters on a display of a user interface of the air conditioner in response to each signal of the plurality of signals being received at the air conditioner.

8 Claims, 5 Drawing Sheets

DIAGNOSTIC DISPLAY METHOD FOR AN AIR CONDITIONER UNIT

FIELD OF THE INVENTION

The present subject matter relates generally to air conditioners, such as packaged terminal air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. Generally, one-unit type air conditioner units include an indoor portion and an outdoor portion. The indoor portion is generally located indoors, and the outdoor portion is generally located outdoors. Accordingly, the air conditioner unit generally extends through a wall, window, etc. of the structure.

Certain one-unit type air conditioner units are connected to a wall thermostat. The wall thermostat can measure a temperature of air in an associated room and regulate operation of the one-unit type air conditioner unit based upon the measured temperature. The wall thermostat can be connected to one-unit type air conditioner unit by wiring that runs through walls of the associated room.

Debugging a bad connection between the wall thermostat and the one-unit type air conditioner unit is difficult. Various disparate conditions can interrupt the connection between the wall thermostat and the one-unit type air conditioner unit. For example, the wall thermostat may be faulty, the wiring within the walls may be severed, or the wiring may be connected to an incorrect terminal at the wall thermostat or the one-unit type air conditioner unit

BRIEF DESCRIPTION OF THE INVENTION

The present subject matter provides a method for operating an air conditioner that includes transmitting a plurality of signals between a remote user interface and the air conditioner through a plurality of wires that extend between the remote user interface and the air conditioner when the air conditioner is in a diagnostic mode. Each signal of the plurality of signals corresponds to a respective one of the plurality of wires. The method also include sequentially presenting a respective one or more characters on a display of a user interface of the air conditioner in response to each signal of the plurality of signals being received at the air conditioner. Additional aspects and advantages of the invention will be set forth in part in the following description, or may be apparent from the description, or may be learned through practice of the invention.

In a first example embodiment, a method for operating an air conditioner includes activating a diagnostic mode of the air conditioner and transmitting a plurality of signals between a remote user interface and the air conditioner through a plurality of wires that extend between the remote user interface and the air conditioner when the air conditioner is in the diagnostic mode. Each signal of the plurality of signals corresponds to a respective one of the plurality of wires. The method also include sequentially presenting a respective one or more characters on a display of a user interface of the air conditioner in response to each signal of the plurality of signals being received at the air conditioner. The display of the user interface includes a pair of segment displays. Each segment display of the pair of segment displays includes no less than seven segments.

In a second example embodiment, an air conditioner system includes a remote user interface. A sealed system has a compressor, an interior coil and an exterior coil. The compressor is operable to increase a pressure of a refrigerant. A user interface has a display with a pair of segment displays. Each segment display of the pair of segment displays includes no less than seven segments. A controller is in operative communication with the compressor, the remote user interface and the user interface. The controller is configured for activating a diagnostic mode of the air conditioner and receiving a plurality of signals from the remote user interface through a plurality of wires that extend between the remote user interface and the air conditioner when the air conditioner is in the diagnostic mode. Each signal of the plurality of signals corresponds to a respective one of the plurality of wires. The method also includes sequentially presenting a respective one or more characters on the display of the user interface in response to each signal of the plurality of signals being received from the remote user interface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
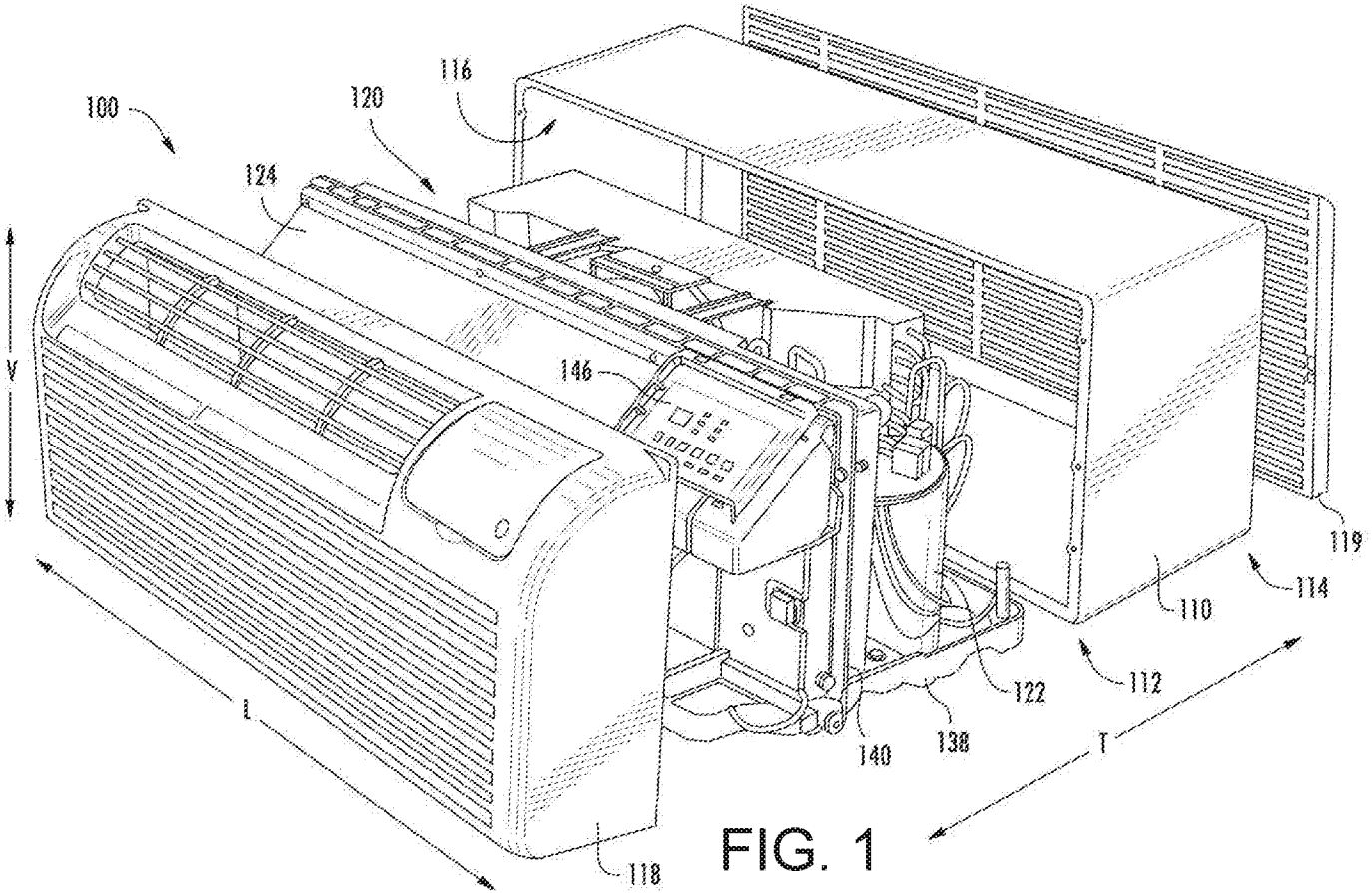
FIG. 1 is an exploded perspective view of a packaged terminal air conditioner unit according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an example embodiment of the present subject matter. It will be understood that, while described in greater detail below in the context of packaged terminal air conditioner unit 100, the present subject matter may be used in or with any suitable air conditioner. For example, the present subject matter may be used in or with any suitable package terminal air conditioner, package terminal heat pump, single package vertical air conditioner, mini-split, etc.

Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air. Packaged terminal air conditioner unit 100 defines a vertical direction V, a lateral direction L and a transverse direction T that are mutually perpendicular and form an orthogonal direction system.

As used herein, the term "packaged terminal air conditioner unit" is used broadly. For example, packaged terminal air conditioner unit 100 may include a supplementary electric heater (not shown) for assisting with heating air within the associated room or building without operating the sealed system 120. However, as discussed in greater detail below, packaged terminal air conditioner unit 100 may also include a heat pump heating mode that utilizes sealed system 120, e.g., in combination with an electric resistance heater, to heat air within the associated room or building. Thus, it should be understood that "packaged terminal air conditioner unit" as used herein is intended to cover both units with and without heat pump heating modes.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 hinder or limit access to mechanical compartment 116 of casing 110. Front panel 118 is positioned at or adjacent interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall or bulkhead 140 positioned within mechanical compartment 116 of casing 110. Sealed system 120 is positioned on bottom tray 138. Thus, liquid runoff from sealed system 120 may flow into and collect within bottom tray 138. Bulkhead 140 may be mounted to bottom tray 138 and extend upwardly from bottom tray 138 to a top wall of casing 110. Bulkhead 140 limits or prevents air flow between interior side portion 112 of casing 110 and exterior side portion 114 of casing 110 within mechanical compartment 116 of casing 110. Thus, bulkhead 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to cool or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
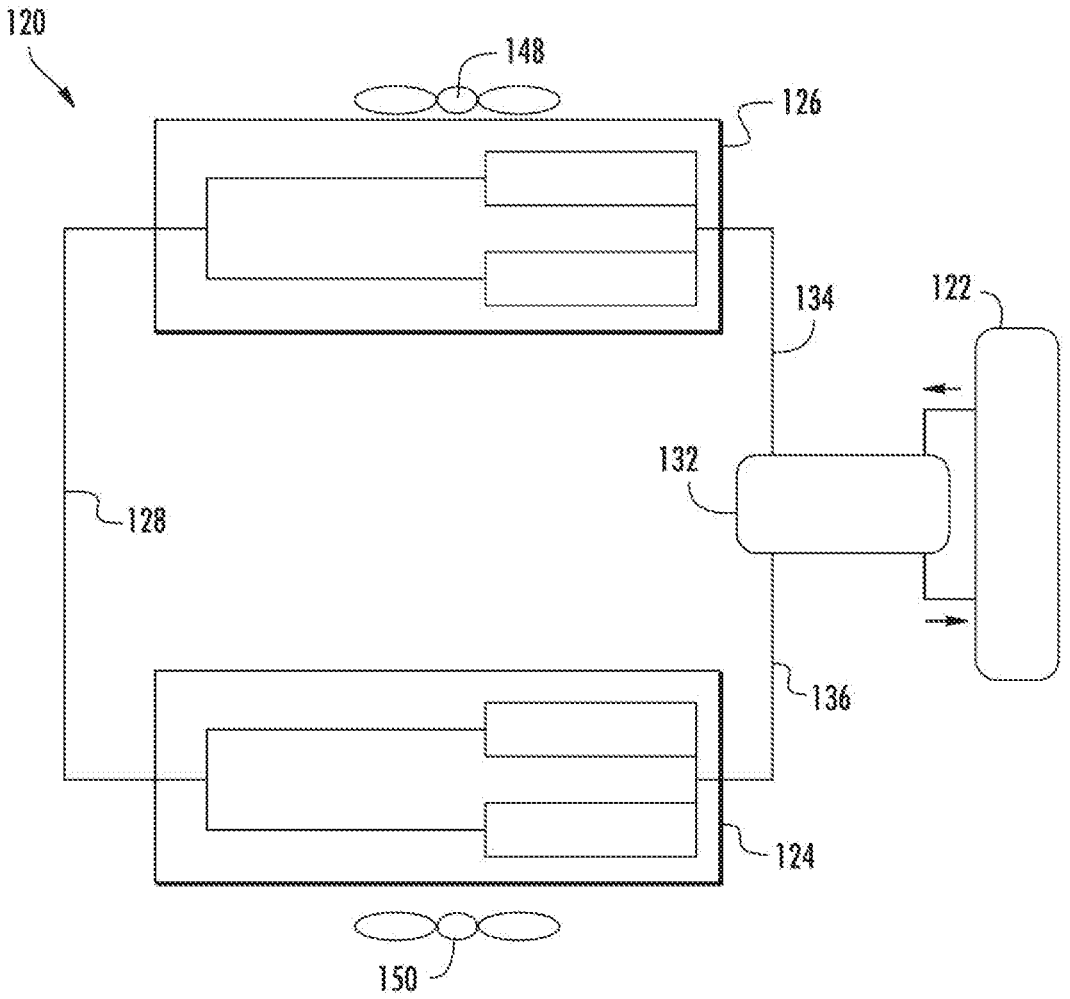
FIG. 2 is a schematic view of certain components of the example packaged terminal air conditioner unit of FIG. 1.

FIG. 2 provides a schematic view of certain components of packaged terminal air conditioner unit 100, including sealed system 120. Sealed system 120 generally operates in a heat pump cycle. Sealed system 120 includes a compressor 122, an interior heat exchanger or coil 124 and an exterior heat exchanger or coil 126. As is generally understood, various conduits may be utilized to flow refrigerant between the various components of sealed system 120. Thus, e.g., interior coil 124 and exterior coil 126 may be between and in fluid communication with each other and compressor 122.

As may be seen in FIG. 2, sealed system 120 may also include a reversing valve 132. Reversing valve 132 selectively directs compressed refrigerant from compressor 122 to either interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to interior coil 124. Thus, reversing valve 132 permits sealed system 120 to adjust between the heating mode and the cooling mode, as will be understood by those skilled in the art.

During operation of sealed system 120 in the cooling mode, refrigerant flows from interior coil 124 flows through compressor 122. For example, refrigerant may exit interior coil 124 as a fluid in the form of a superheated vapor. Upon exiting interior coil 124, the refrigerant may enter compressor 122. Compressor 122 is operable to compress the refrigerant. Accordingly, the pressure and temperature of the refrigerant may be increased in compressor 122 such that the refrigerant becomes a more superheated vapor.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via a first distribution conduit 134 that extends between and fluidly connects reversing valve 132 and exterior coil 126. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer.

Sealed system 120 also includes a capillary tube 128 disposed between interior coil 124 and exterior coil 126, e.g., such that capillary tube 128 extends between and fluidly couples interior coil 124 and exterior coil 126. Refrigerant, which may be in the form of high liquid quality/saturated liquid vapor mixture, may exit exterior coil 126 and travel through capillary tube 128 before flowing through interior coil 124. Capillary tube 128 may generally expand the refrigerant, lowering the pressure and temperature thereof. The refrigerant may then be flowed through interior coil 124.

Interior coil 124 is disposed downstream of capillary tube 128 in the cooling mode and acts as an evaporator. Thus, interior coil 124 is operable to heat refrigerant within interior coil 124 with energy from the interior atmosphere at interior side portion 112 of casing 110 when sealed system 120 is operating in the cooling mode. For example, the liquid or liquid vapor mixture refrigerant from capillary tube 128 may enter interior coil 124 via a second distribution conduit 136 that extends between and fluidly connects interior coil 124 and reversing valve 132. Within interior coil 124, the refrigerant from capillary tube 128 receives energy from the interior atmosphere and vaporizes into superheated vapor and/or high quality vapor mixture. An interior air handler or fan 150 is positioned adjacent interior coil 124 may facilitate or urge a flow of air from the interior atmosphere across interior coil 124 in order to facilitate heat transfer.

During operation of sealed system 120 in the heating mode, reversing valve 132 reverses the direction of refrigerant flow through sealed system 120. Thus, in the heating mode, interior coil 124 is disposed downstream of compressor 122 and acts as a condenser, e.g., such that interior coil 124 is operable to reject heat into the interior atmosphere at interior side portion 112 of casing 110. In addition, exterior coil 126 is disposed downstream of capillary tube 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative example embodiments, sealed system 120 may include any suitable components for heating and/or cooling air with a refrigerant. For example, an auxiliary electric heating element may be provided to supplement the heating provided by sealed system 120 in the heat pump mode. Sealed system 120 may also have any suitable arrangement or configuration of components for heating and/or cooling air with a refrigerant in alternative example embodiments.

Figure 3:
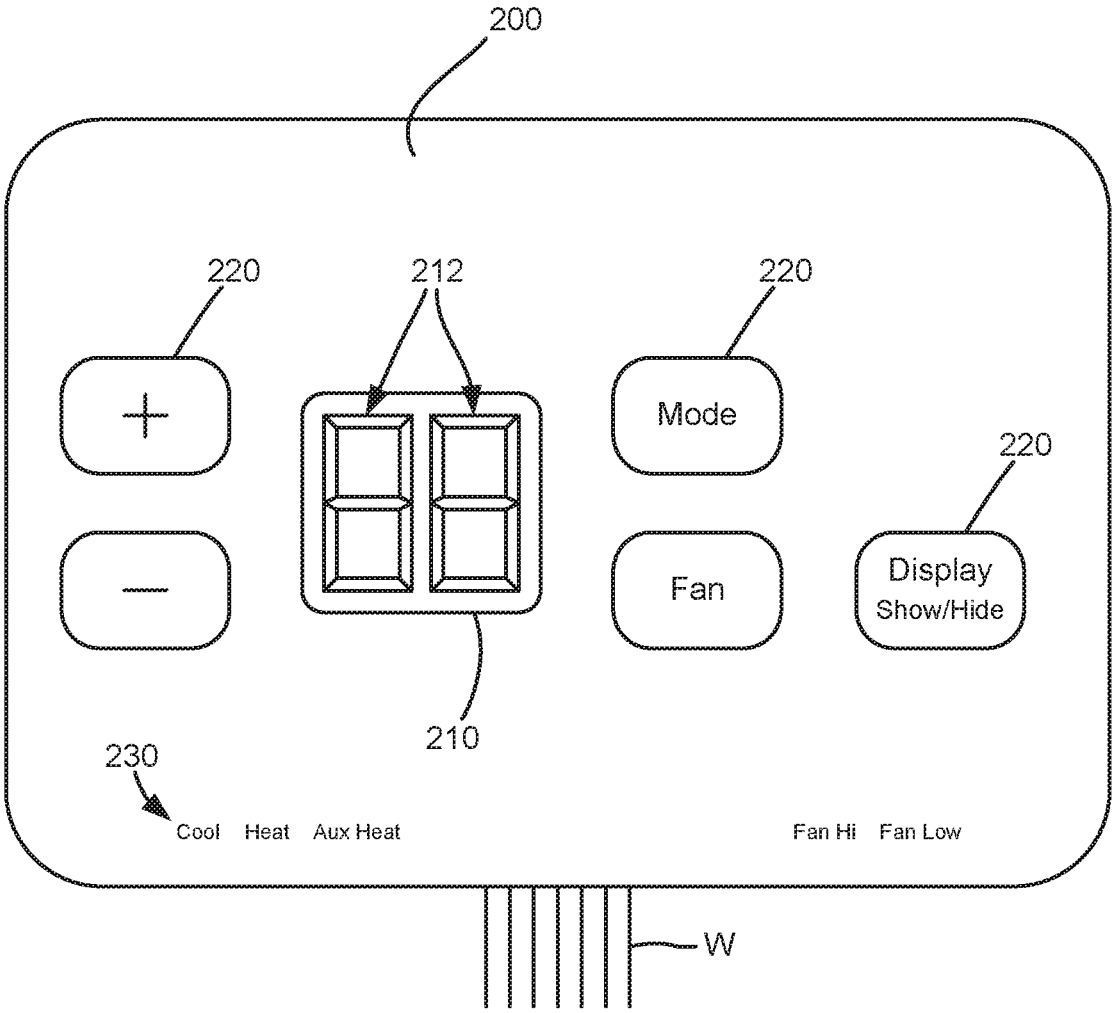
FIG. 3 is a front, elevation view of a user interface panel of the example packaged terminal air conditioner unit of FIG. 1.
Figure 4:
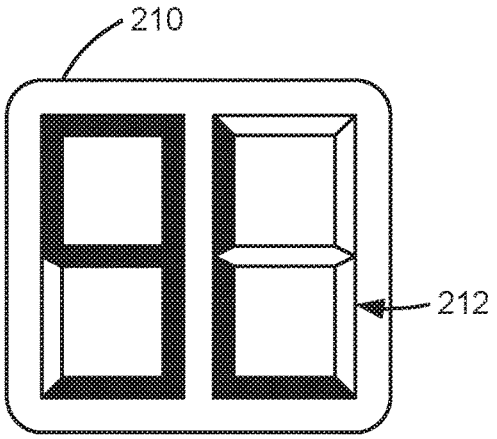
FIGS. 4 through 9 are front, elevation views of a display of the user interface panel of FIG. 3 in which segment displays are shown with various characters.

FIG. 3 is a front, elevation view of a user interface panel 200 of packaged terminal air conditioner unit 100. User interface panel 200 is in operative communication with controller 146. Thus, e.g., a user may input commands at user interface panel 200, and controller 146 may adjust operation of sealed system 120 or other components of packaged terminal air conditioner unit 100 in response to command signals from user interface panel 200. User interface panel 200 may be a local user interface, e.g., such that user interface panel 200 is mounted to bulkhead 140 or some other component of packaged terminal air conditioner unit 100, and a user may utilize user interface panel 200 at or adjacent packaged terminal air conditioner unit 100 to adjust operation of packaged terminal air conditioner unit 100. In alternative example embodiments, user interface panel 200 may be a remote user interface, e.g., a wall mounted thermostat, and the user may utilize user interface panel 200 away from packaged terminal air conditioner unit 100 to adjust operation of packaged terminal air conditioner unit 100.

User interface panel 200 includes a display 210 and a plurality of input components 220. Input components 220 may be one or more of a variety of touch-type controls, electrical, mechanical or electro-mechanical input devices including knobs, rotary dials, push buttons, touch pads, etc. Display 210 is designed to provide visual feedback to a user of packaged terminal air conditioner unit 100.

Display 210 includes a pair of segment displays 212. Segment displays 212 may include no less than seven segments. For example, each segment display 212 may include exactly seven segments in certain example embodiments. Thus, segment displays 212 may be seven segment displays. In alternative example embodiments, segment displays 212 may be nine segment displays, fourteen segment displays, sixteen segment displays, etc. As shown in FIG. 3, segment displays 212 may include exactly two segment displays 212. Thus, e.g., display 210 may offer limited informational display states relative to other known displays, such as LCD screens, vacuum fluorescent displays, dot matrix displays, etc. As discussed in greater detail below, display 210 may be advantageously utilized to communicate when a remote user interface is properly wired despite the limited informational display states provided by segment displays 212.

As noted above, user interface panel 200 may be utilized as a local user interface and/or a remote user interface. In particular, packaged terminal air conditioner unit 100 may include two user interface panels 200, with one of the two user interface panels 200 configured as the local user interface and the other of the two user interface panels 200 configured as the remote user interface. Controller 146 may be in operative communication with both user interface panels 200. For example, wiring W may extend between the one of user interface panels 200 configured as the remote user interface and a terminal connection positioned at controller 146. Wiring W is known in the art is not described in great detail herein.

The wiring W includes a plurality of wires, e.g., with no less than five wires and no more than eight wires. The wiring W may extend within walls in a room within which packaged terminal air conditioner unit 100 is located. Control signals may be transmitted through the wiring W between the remote user interface and controller 146. Thus, a user may regulate operation of packaged terminal air conditioner unit 100 utilizing the remote user interface despite being located away from controller 146.

Various conditions can interrupt signal communication between the remote user interface and controller 146 such that the remote user interface cannot be used to adjust operation of packaged terminal air conditioner unit 100. For example, the one of user interface panels 200 configured as the remote user interface may be faulty, the wiring W may be severed between the remote user interface and the controller 146, or one or more of the wires in the wiring W may be connected to an incorrect terminal at the remote user interface or at the terminal connection positioned at controller 146.

A user may initiate a diagnostic mode of packaged terminal air conditioner unit 100 to test the signal communication between the remote user interface and controller 146. For example, the user may utilize input components 220 on one of user interface panels 200 to activate the diagnostic mode. In the diagnostic mode, the remote user interface may transmit one or more signals on each wire of the wiring W between the remote user interface and controller 146. In certain example embodiments, one of the wires in the wiring W may be a live wire that is supplied with a suitable voltage (e.g., twelve volts or twenty-four volts), and another one of the wires in the wiring W may be common wire (e.g., that is grounded). Thus, the signal communication between the remote user interface and controller 146 may be binary, i.e., each wire in the wiring W between the remote user interface and controller 146 may be either at the voltage of the live wire or at the voltage of the common wire. The remote user interface may selectively connect each of the other wires in the wiring W (e.g., other than the common wire) to the live wire such that each of the other wires in the wiring W is selectively supplied with the voltage from the live wire or is grounded to the common wire. In such a manner, the remote user interface and controller 146 may communicate with each other by shifting the voltages on the wiring W between the remote user interface and controller 146 during the diagnostic mode.

In the diagnostic mode, packaged terminal air conditioner unit 100 utilizes segment displays 212 of the one of user interface panels 200 configured as the local user interface to communicate the status of the connection between the one of user interface panels 200 configured as the remote user interface and controller 146. In particular, segment displays 212 of the local user interface are utilized to communicate whether there is proper signal communication between the remote user interface and controller 146. For example, display 210 may sequentially present a respective one or more characters on display 210 of the local user interface in response to each signal being received at controller 146. The respective one or more characters may include a letter, a number or both.

As noted above, each wire within the wiring W may transmit a respective control signal between the remote user interface and controller 146. For example, in addition to the live wire and the common wire, the wires in the wiring W may include a suitable combination of: a low fan wire; a high fan wire; a reversing valve wire; a compressor speed wire(s); and/or an electric heater wire. Thus, e.g., controller 146 may be configured to adjust a speed of interior air handler 150 in response to control signals on the low fan wire and the high fan wire. As another example, controller 146 may be configured to actuate reversing valve 132 in response to control signals on the reversing valve wire. Controller 146 may also be configured to adjust a speed of compressor 122 in response to control signals on the compressor speed wire(s) and/or to activate an electric heating element in response to control signals on the electric heater wire. Other suitable wires and control signals may be provided to permit a user to regulate operation of packaged terminal air conditioner unit 100 at the remote user interface.

Each of the respective one or more characters on display 210 of the local user interface may only be presented in response to receiving the appropriate signal from the remote user interface. FIGS. 4 through 9 are front, elevation views of display 210 of the local user interface with segment displays 212 shown with various characters. In particular, one of segment displays 212 (e.g., a leftmost one of segment displays 212) presents the character "9" and the other of segment displays 212 (e.g., a rightmost one of segment displays 212) presents the character "L." Thus, a viewer of segment displays 212 may understand the characters on segments displays 212 in FIG. 4 to correspond to "GL" which corresponds to a low fan signal. During the diagnostic mode, a user at the remote user interface may utilize input components 220 to generate a command signal to operate interior air handler 150 at a low speed. When controller 146 receives the signal from the remote user interface on the low fan wire of the wiring W, controller 146 may present the characters shown in FIG. 4 on display 210 of the local user interface to indicate that the low fan wire is properly connected and transmits the command signal from the remote user interface to controller 146.

Figure 5:
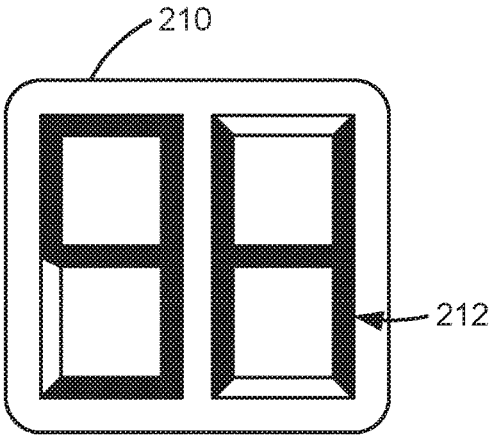
Figure 6:
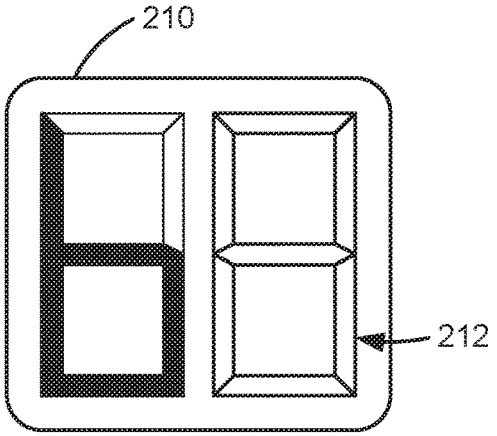
Figure 7:
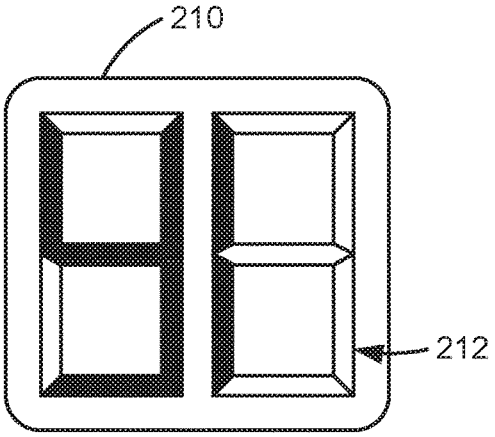
Figure 8:
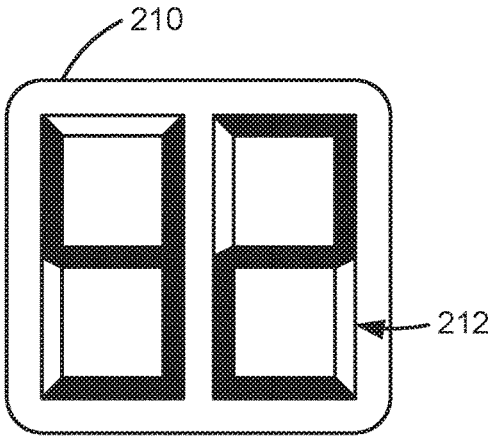
Figure 9:
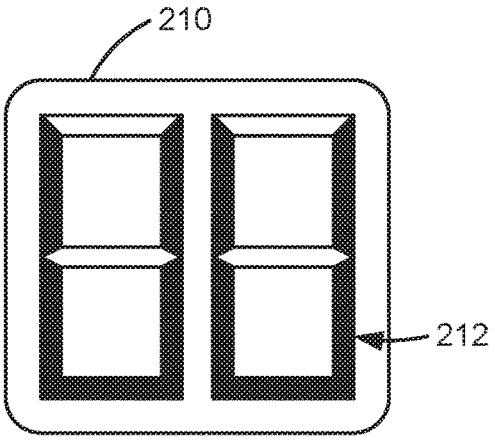
Figure 10:
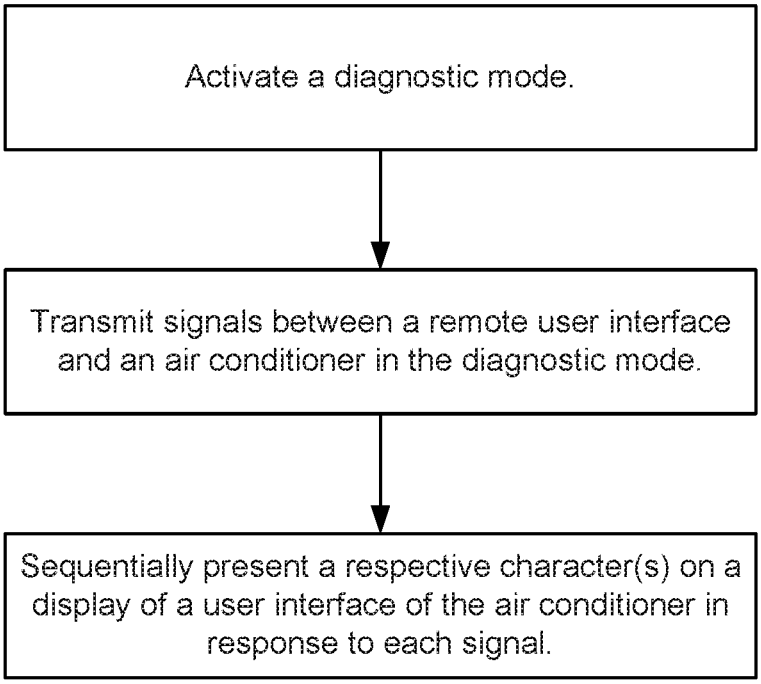
FIG. 10 is a flowchart of a method for operating an air conditioner according to an example embodiment of the present subject matter.

The character(s) shown in FIGS. 5 through 9 may be presented on display 210 to indicate that other wires in the wiring W are properly connected and a respective command signal from the remote user interface is received at controller 146. In FIG. 5, the one of segment displays 212 presents the character "9" and the other of segment displays 212 presents the character "H." Thus, a viewer of segment displays 212 may understand the characters on segments displays 212 in FIG. 5 to correspond to "GH" which corresponds to a high fan signal. In FIG. 6, the one of segment displays 212 presents the character "6" and the other of segment displays 212 is blank and presents no character. Thus, a viewer of segment displays 212 may understand the character on segments displays 212 in FIG. 6 to correspond to "B" which corresponds to a reversing valve signal. In FIG. 7, the one of segment displays 212 presents the character "Y" and the other of segment displays 212 presents the character "1." Thus, a viewer of segment displays 212 may understand the character on segments displays 212 in FIG. 7 to correspond to "Y1" which corresponds to a high compressor signal. In FIG. 8, the one of segment displays 212 presents the character "Y" and the other of segment displays 212 presents the character "2." Thus, a viewer of segment displays 212 may understand the character on segments displays 212 in FIG. 8 to correspond to "Y2" which corresponds to a low compressor signal. In FIG. 9, the one of segment displays 212 presents the character "U" and the other of segment displays 212 also presents the character "U." Thus, a viewer of segment displays 212 may understand the character on segments displays 212 in FIG. 8 to correspond to "W" which corresponds to an electric heater signal. It will be understood that the characters shown in FIGS. 5 through 9 are provided by way of example only. Other suitable charters are within the scope of the present subject matter.

During the diagnostic mode, the user at the remote user interface may utilize input components 220 to generate various command signals to operate components of packaged terminal air conditioner unit 100. When controller 146 receives the signals from the remote user interface on the wiring W, controller 146 may sequentially present the characters shown in FIGS. 4 through 9 on display 210 to indicate that the wiring W is properly connected and transmits the command signal from the remote user interface to controller 146.

During the diagnostic mode, the user at the remote user interface may only utilize input components 220 to generate a subset of the available command signals. For example, the user may utilize input components 220 to command controller 146 to adjust interior air handler 150 to a high speed and compressor 122 to a low speed. In such case, the user would expect to see "GH" and "Y1" sequentially presented on the display 210 of the local user interface. As another example, the user may utilize input components 220 to command controller 146 to adjust interior air handler 150 to a low speed and reversing valve 132 to a heat pump mode. In such case, the user would expect to see "GL" and "B" sequentially presented on the display 210 of the local user interface. As yet another example, the user may utilize input components 220 to command controller 146 to adjust interior air handler 150 to the low speed, reversing valve 132 to the heat pump mode, and activate an electric heating element. In such case, the user would expect to see "GL," "B" and "W" sequentially presented on the display 210 of the local user interface.

If the user sees the expected characters on display 210 of the local user interface, the wiring W is properly connected to transmit the appropriate command signals from the remote user interface to controller 146. Conversely, if one or more of the characters is not presented on display 210 of the local user interface, the wiring W is not transmitting the appropriate command signals from the remote user interface to controller 146. In such case, the user can take appropriate action to correct the wiring W, replace the remote user interface, etc.

As may be seen from the above, segment displays 212 on the one of user interface panels 200 configured as the local user interface advantageously communicate to the user that the other of user interface panels 200 configured as the remote user interface is properly connected to the controller 146 via the wiring W, e.g., despite only having two segment displays 212.

As shown in FIG. 3, user interface panel 200 may also include a plurality of function indicators 230. Function indicators 230 may be backlit text on user interface panel 200, e.g., such that the text at outer surface of user interface panel 200 is visible when an LCD or other suitable light emitter is activated within user interface panel 200. A respective one of function indicators 230 on the local user interface may also be activated in response to receiving the appropriate signal from the remote user interface. Thus, function indicators 230 may complement display 210 on the local user interface in communicating the status of the connection between the one of user interface panels 200 configured as the remote user interface and controller 146.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating an air conditioner, comprising:

activating a diagnostic mode of the air conditioner;

transmitting a plurality of signals between a remote user interface and the air conditioner through a plurality of wires that extend between the remote user interface and the air conditioner when the air conditioner is in the diagnostic mode, each signal of the plurality of signals corresponding to a respective wire of the plurality of wires; and sequentially presenting a respective one or more characters on a display of a user interface of the air conditioner in response to each signal of the plurality of signals being received at the air conditioner, wherein the display of the user interface comprises only two segment displays, each segment display of the only two segment displays is a seven-segment display, and the display of the user interface is positioned on the air conditioner.

2. The method of claim 1, the plurality of wires comprises no less than five wires and no more than eight wires.

3. The method of claim 1, wherein each character of the respective one or more characters comprises a letter, a number or both.

4. The method of claim 1, further comprising activating a respective one of a plurality of function indicators on the user interface in response to each signal of the plurality of signals being received at the air conditioner.

5. An air conditioner system, comprising:

a remote user interface;

a sealed system having a compressor, an interior coil and an exterior coil, the compressor operable to increase a pressure of a refrigerant;

a user interface having a display with only two segment displays, each segment display of the only two segment displays being a seven-segment display, the display of the user interface positioned on a casing that houses the sealed system;

a controller in operative communication with the compressor, the remote user interface and the user interface, the controller configured for activating a diagnostic mode of the air conditioner;

receiving a plurality of signals from the remote user interface through a plurality of wires that extend between the remote user interface and the air conditioner when the air conditioner is in the diagnostic mode, each signal of the plurality of signals corresponding to a respective wire of the plurality of wires; and sequentially presenting a respective one or more characters on the display of the user interface in response to each signal of the plurality of signals being received from the remote user interface.

6. The air conditioner system of claim 5, the plurality of wires comprises no less than five wires and no more than eight wires.

7. The air conditioner system of claim 5, wherein each character of the respective one or more characters comprises a letter, a number or both.

8. The air conditioner system of claim 5, further comprising activating a respective one of a plurality of function indicators on the user interface in response to each signal of the plurality of signals being received at the air conditioner.

* * * * *